US009283130B2

(12) United States Patent
Walker et al.

(10) Patent No.: US 9,283,130 B2
(45) Date of Patent: Mar. 15, 2016

(54) LIFTING APPARATUS

(71) Applicant: Autochair Limited, Alfreton (GB)

(72) Inventors: David Leslie Walker, Bakewell (GB); Matthew James Walker, Darley Dale (GB); Christopher John Sloss, Dore (GB)

(73) Assignee: AUTOCHAIR LIMITED, Alfreton (GB)

( * ) Notice: Subject to any disclaimer, the term of this patent is extended or adjusted under 35 U.S.C. 154(b) by 0 days.

(21) Appl. No.: 13/644,670

(22) Filed: Oct. 4, 2012

(65) Prior Publication Data

US 2013/0087521 A1 Apr. 11, 2013

(30) Foreign Application Priority Data

Oct. 5, 2011 (GB) ..... 1117251.7

(51) Int. Cl.
*B66C 23/00* (2006.01)
*A61G 3/06* (2006.01)
*B66C 23/44* (2006.01)

(52) U.S. Cl.
CPC ..... *A61G 3/062* (2013.01); *B66C 23/44* (2013.01); *B66C 23/54* (2013.01); *A61G 2203/78* (2013.01)

(58) Field of Classification Search
CPC ..... B66C 23/44; B66C 23/48; B66C 23/54
USPC ..... 254/323, 325, 328, 245, 250, 251, 253, 254/257, 134, 30, 2 R, 2 B, 3 B, 4 B, 8 B; 414/462–466
See application file for complete search history.

(56) References Cited

U.S. PATENT DOCUMENTS

| | | | | |
|---|---|---|---|---|
| 573,703 | A | 12/1896 | Robbins | |
| 2,846,091 | A * | 8/1958 | Heffner | 414/550 |
| 3,207,044 | A * | 9/1965 | Hall | 91/530 |
| 3,263,822 | A * | 8/1966 | Weinman | 212/301 |
| 3,521,860 | A * | 7/1970 | Zehrung, Jr. et al. | 254/8 R |
| 3,659,594 | A * | 5/1972 | Schwab | 606/237 |

(Continued)

FOREIGN PATENT DOCUMENTS

| | | |
|---|---|---|
| DE | 3917240 | 11/1990 |
| EP | 0727384 | 8/1996 |

(Continued)

OTHER PUBLICATIONS

European Examination Report for EP Pat. App. 12187485.3 dated Mar. 27, 2014, EPO, Netherlands.

(Continued)

*Primary Examiner* — Emmanuel M Marcelo
*Assistant Examiner* — Michael Gallion
(74) *Attorney, Agent, or Firm* — Trego, Hines & Ladenheim, PLLC

(57) ABSTRACT

Disclosed is a hoist mechanism comprising a lifting arm wherein: when the lifting arm is in a fully raised position, a projecting upper end section of a major part of the lifting arm extends substantially horizontally; an effective length of the projecting upper end section is made variable by the provision of an extension element adjustably fixed to it; and the lifting arm is variable in upstanding height by a provision of a lower end section slidably connected to the major part of the lifting arm, wherein both length and height variations are made by stepless adjustments.

10 Claims, 3 Drawing Sheets

(56) References Cited

U.S. PATENT DOCUMENTS

| | | | | | |
|---|---|---|---|---|---|
| 3,694,829 | A | * | 10/1972 | Bakker | 5/87.1 |
| 3,746,193 | A | * | 7/1973 | Eaves | 414/569 |
| 3,759,399 | A | * | 9/1973 | Glass et al. | 212/180 |
| 3,760,956 | A | * | 9/1973 | Burch | 414/744.3 |
| 3,784,035 | A | * | 1/1974 | Dunbar | 414/543 |
| 3,804,263 | A | * | 4/1974 | Castonguay | 212/180 |
| 3,999,228 | A | * | 12/1976 | Thomas | 5/83.1 |
| 4,226,331 | A | * | 10/1980 | Dumond | 212/258 |
| 4,296,509 | A | * | 10/1981 | Simmons et al. | 5/85.1 |
| 4,314,622 | A | * | 2/1982 | Lindquist | 182/2.11 |
| 4,365,924 | A | * | 12/1982 | Brigman et al. | 414/549 |
| 4,523,684 | A | * | 6/1985 | Baisden | 212/175 |
| 4,596,336 | A | * | 6/1986 | Zwagerman | 212/296 |
| 4,606,082 | A | * | 8/1986 | Kuhlman | 4/561.1 |
| 4,606,430 | A | * | 8/1986 | Roby et al. | 182/3 |
| 4,607,716 | A | * | 8/1986 | Beck | 180/401 |
| 4,644,595 | A | * | 2/1987 | Daniel | 5/83.1 |
| 4,818,172 | A | * | 4/1989 | Johnson | 414/686 |
| 4,881,864 | A | * | 11/1989 | Amato | 414/543 |
| 4,930,188 | A | * | 6/1990 | Hyde | 452/192 |
| 4,991,810 | A | * | 2/1991 | Andrus et al. | 248/286.1 |
| 5,072,840 | A | * | 12/1991 | Asakawa et al. | 212/312 |
| 5,077,844 | A | * | 1/1992 | Twitchell et al. | 5/87.1 |
| 5,092,733 | A | * | 3/1992 | Kishi | 414/718 |
| 5,127,791 | A | * | 7/1992 | Attman | 414/814 |
| 5,203,541 | A | * | 4/1993 | Nix | 254/218 |
| 5,282,714 | A | * | 2/1994 | Diebolt | 414/680 |
| 5,337,908 | A | * | 8/1994 | Beck, Jr. | 212/312 |
| 5,365,621 | A | * | 11/1994 | Blain | 5/87.1 |
| 5,379,468 | A | * | 1/1995 | Cassidy et al. | 5/86.1 |
| 5,459,891 | A | * | 10/1995 | Reeve et al. | 5/87.1 |
| 5,494,117 | A | * | 2/1996 | Aldridge | 173/28 |
| 5,645,180 | A | | 7/1997 | Zaguroli, Jr. | |
| 5,788,095 | A | * | 8/1998 | Watson | 212/180 |
| 5,918,328 | A | * | 7/1999 | Ramsey | 5/84.1 |
| 5,934,437 | A | * | 8/1999 | Anson et al. | 193/15 |
| 6,006,377 | A | * | 12/1999 | Asakawa | 5/83.1 |
| 6,026,523 | A | * | 2/2000 | Simon et al. | 5/81.1 R |
| 6,035,465 | A | * | 3/2000 | Rogozinski | 5/83.1 |
| 6,045,320 | A | * | 4/2000 | Cullen | 414/724 |
| 6,095,349 | A | * | 8/2000 | O'Meara | 212/180 |
| 6,102,220 | A | * | 8/2000 | Becker | 212/196 |
| 6,199,412 | B1 | * | 3/2001 | Kennedy | 70/18 |
| 6,202,868 | B1 | * | 3/2001 | Murray | 212/294 |
| 6,289,534 | B1 | * | 9/2001 | Hakamiun et al. | 5/89.1 |
| 6,329,612 | B1 | * | 12/2001 | von Schroeter | 177/144 |
| 6,464,208 | B1 | * | 10/2002 | Smith | 254/324 |
| 6,547,218 | B2 | * | 4/2003 | Landy | 254/217 |
| 6,694,545 | B1 | * | 2/2004 | Renton | 5/86.1 |
| 6,776,488 | B2 | * | 8/2004 | Burbulla | 352/243 |
| 6,880,810 | B1 | * | 4/2005 | Hu | 254/218 |
| 6,981,834 | B1 | * | 1/2006 | Henry | 414/462 |
| 7,032,289 | B2 | * | 4/2006 | Oliver et al. | 29/596 |
| 7,296,636 | B1 | * | 11/2007 | Vreeland | 173/184 |
| 7,462,138 | B2 | * | 12/2008 | Shetty et al. | 482/69 |
| 7,657,951 | B2 | * | 2/2010 | Tally | 5/86.1 |
| 7,669,255 | B2 | * | 3/2010 | Raney | 5/86.1 |
| 7,845,622 | B1 | * | 12/2010 | Riggs | 254/326 |
| 7,878,484 | B2 | * | 2/2011 | Kitchens, Sr. | 254/326 |
| 7,921,484 | B2 | * | 4/2011 | Bendele et al. | 5/83.1 |
| 8,056,674 | B2 | * | 11/2011 | Bean et al. | 182/2.9 |
| 8,099,806 | B2 | * | 1/2012 | Chepurny et al. | 5/81.1 R |
| 8,584,275 | B2 | * | 11/2013 | Nelson et al. | 5/87.1 |
| 2001/0011694 | A1 | * | 8/2001 | Lycett | 248/228.1 |
| 2001/0045548 | A1 | * | 11/2001 | Landy | 254/217 |
| 2005/0011560 | A1 | * | 1/2005 | Anderson et al. | 137/615 |
| 2005/0133769 | A1 | * | 6/2005 | Walls | 254/218 |
| 2005/0217024 | A1 | | 10/2005 | Aarestad | |
| 2007/0221600 | A1 | * | 9/2007 | Davis | 212/270 |
| 2007/0274817 | A1 | | 11/2007 | Chepurny et al. | |
| 2008/0000632 | A1 | * | 1/2008 | Brecheisen | 166/72 |
| 2011/0016628 | A1 | * | 1/2011 | Masterson, Jr. | 5/87.1 |
| 2012/0319064 | A1 | * | 12/2012 | Selkowitz | 254/323 |

FOREIGN PATENT DOCUMENTS

| | | |
|---|---|---|
| EP | 1727765 | 12/2006 |
| FR | 2795157 | 12/2000 |

OTHER PUBLICATIONS

European Search Report for EP Pat. App. 12187485.3 dated Jan. 30, 2013.

* cited by examiner 74
76
60
68

64
86
88
80
82
78
85
88
84
79

52
58
56
56
58
70
64
6
72
54
60
72
6
30
74
62
60
66

LIFTING APPARATUS

BACKGROUND OF THE INVENTION

This invention relates to a hoist mechanism intended primarily, but not only, for use when a disabled person's manual or motor driven wheelchair or scooter is to be loaded into, or unloaded from, the load carrying space of an estate type vehicle or people carrier for example.

Motor driven wheelchairs and scooters are much too heavy to be lifted manually, and frequently need to be loaded into, or unloaded from, the vehicle in which they are transported. Manually operated wheelchairs are of much lesser weight but may be more than an elderly or unfit person can lift with ease into, or from, a motor vehicle. It is, therefore, vitally important that such a hoist mechanism is completely reliable and easy to use. It is also advantageous if any necessary adjustments to such a hoist mechanism, when transferring it for use to another suitable vehicle, are able to be made relatively easily.

The kind of hoist with which the invention is concerned includes an upstanding pivot post which is to be secured within and to one side of the load carrying space of a vehicle, and a lifting arm pivotally connected at a lower end of said pivot post, an actuator member being, at one end, pivotally connected at or near the upper end of said pivot post and at its other end pivotally connected to an intermediate point along the length of the lifting arm, the arrangement being such that, in use, as the working length of the actuator is reduced the lifting arm is raised, and as the working length of the actuator is increased the lifting arm is lowered.

BRIEF DESCRIPTION OF THE INVENTION

According to the invention, there is provided a hoist mechanism of the kind referred to in which, when the lifting arm is in a fully raised position, a projecting upper end section of a major length of said arm extends substantially horizontally, and the effective length of said projecting upper end section is made variable by the provision of an extension element adjustably fixed to it, and in which also the lifting arm is variable in upstanding height by the provision of lower end section slidably connected to said major part, both length variations being made by stepless adjustments. The major part of the lifting arm may be formed with longitudinally extending undercut slots along its side edges, these providing the means whereby a bracket pivotally connecting the actuator to the lifting arm can be steplessly adjusted in position along the length of the major part, the undercut grooves housing clamping plates with tapped holes which can be engaged by clamping bolts extending through clearance holes in side walls of the bracket. The side walls of said bracket will preferably be formed with key elements on their inside surfaces, these engaging the longitudinally extending slots in the side walls of the major part of the lifting arm.

At least the major part of the lifting arm may be formed by a length of material having a bore of oval cross section and an external shape which at one end of the oval closely conforms to the shape of the hollow bore within it but at the other end of the oval widens and within the widened wall thickness there is formed the undercut slots previously referred to. The projecting end section of the lifting arm will preferably also be made from a length of the same material, in which case the extent by which the extension element can be caused to project beyond the outer end of the end section of the lifting arm may involve the forming of a slot on the top side of said end section near its outer end, and the fitting of a clamp within said slot to bear down on said extension element. The clamp may be formed from a short length of the material and bolts may extend through clearance holes in said clamp to be received in screw-threaded holes opening from the undersides of the undercut slots previously referred to.

According to a further aspect of the invention, a cross beam extender assembly for a hoist mechanism of the kind referred to includes a lifting bar which, at its opposite ends, is fitted with respective extension elements which are slidably adjustable within its end sections, the outermost ends of said extension elements being provided with respective clamp elements for securely fixing in place flexible lifting straps from which a wheelchair or scooter can be suspended, said outermost ends having a longitudinally extending screw-threaded holes formed in the sidewall thickness of the hollow section from which the extension element has been formed, and the lowermost edge of the cavity opening into the element, into which an end portion of a lifting strap is to be fed, being rounded, and each clamp having a body part shaped in part to match the outer cross sectional shape of the extension element, having clearance holes for bolts which are to engage the screw-threaded holes in the sidewall thickness of the extension element, and having a projecting tongue portion which is to extend into the space remaining above the lifting strap when the end portion of the latter has been entered into it, said tongue portion having a serrated underside, the serrations extending transversely of the length of said tongue portion. The serrations on the underside of the tongue portion will preferably continue in a part-circular arc so that, in use, as clamping is effected, they are spaced from the rounded edge of the lowermost part of the extension element at a distance somewhat less than the thickness of the compressed lifting strap.

The visual appearance of the assembly, and also its safe handling, will preferably be improved by forming the clamp elements with stepped portions in which the bolt heads will be at least partly located, also by rounding those portions which, in use, form the outermost ends of the crossbeam extender assembly.

BRIEF DESCRIPTION OF THE DRAWINGS

The invention may be best understood by reference to the following description taken in conjunction with the accompanying drawing figures in which.

DETAILED DESCRIPTION OF THE INVENTION

Figures 1, 4:
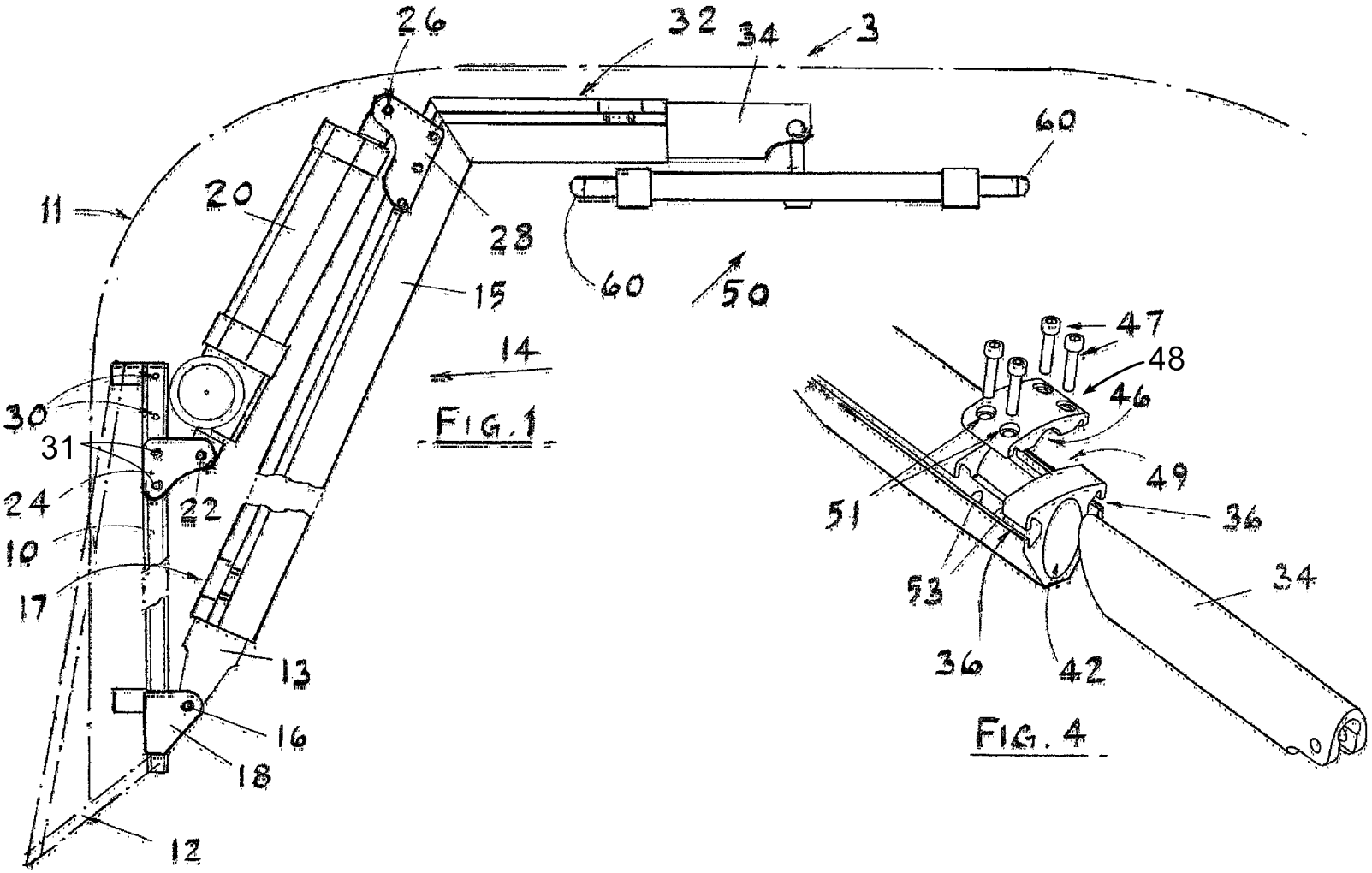
FIG. 1 is a perspective view of the hoist mechanism as it will appear when installed in an estate type vehicle and viewed from the rear of said vehicle.
FIGS. 3 and 4 are more detailed views of parts of the mechanism.

Referring now to FIG. 1 of the drawings, the hoist mechanism there illustrated is shown to have been adjusted and set up in an estate type vehicle for use by a disabled person. It includes a pivot post 10 which, as shown, is mounted in upstanding fashion within and to one side of the load-carrying space of the vehicle. The means by which the pivot post is mounted within the load-carrying space of an estate type vehicle will usually include an A-frame construction such as that crudely illustrated in chain-dotted lines, and generally indicated 12, in FIG. 1, this being securely bolted in position along one side wall of the load-carrying space of the vehicle. (That one side wall and the roof lining of the vehicle in this instance is shown in chain-dotted lines and indicated 11 in FIG. 1)

The pivot post is pivotally connected near its upper and lower ends to an upstanding portion of the A-frame so that, in use of the hoist, it is able to be moved pivotally about a substantially vertical axis.

Figure 2:
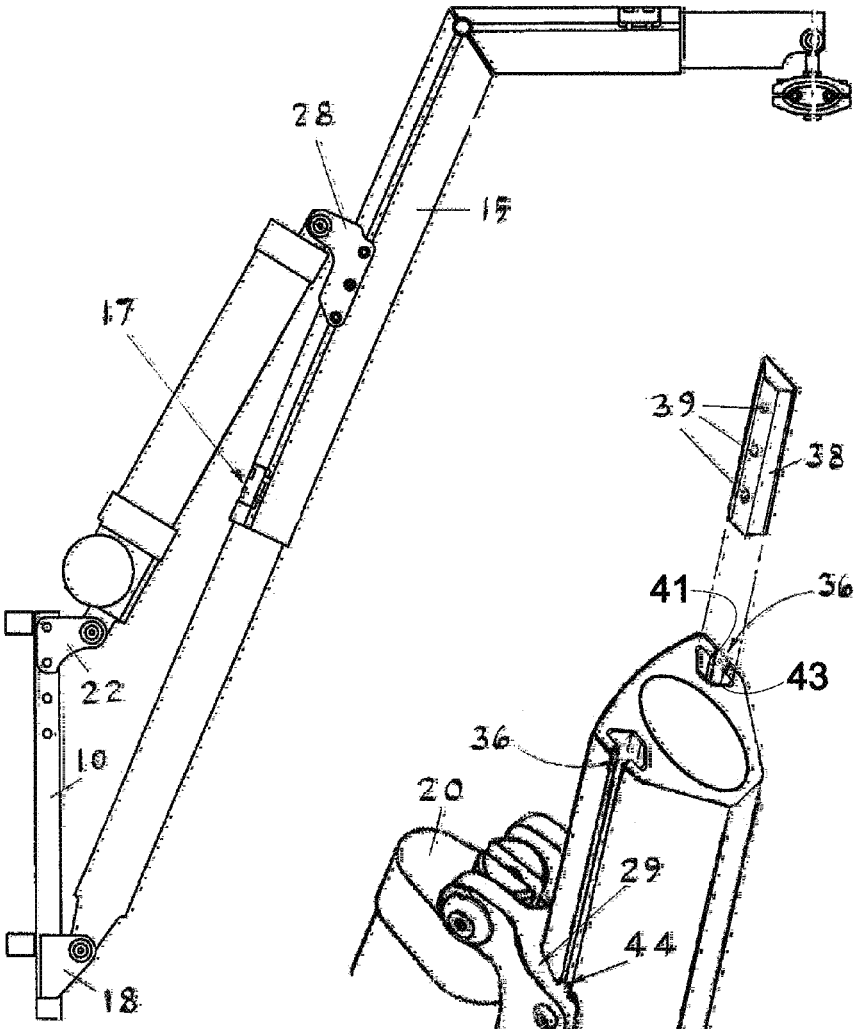
FIG. 2 is a view similar to FIG. 1 but showing the mechanism adjusted and set up for more general use.

A lifting arm, generally indicated 14, is shown to be pivotally connected at 16 to a bracket 18 at the lower end of the pivot post 10. The inclination of said lifting arm is controlled by an actuator 20 (in this case a double acting, electric motor operated actuator) which is, at one end 22, pivotally connected to a bracket 24 located near the upper end of the pivot post, and pivotally connected at its other end 26 to a bracket 28 located near the upper end of what is a major length 15 of the lifting arm. It will be seen that, by means of four equally spaced holes 30 in the pivot post 10, for a pair of bolts 31 by means of which it can be clamped in position, the bracket 24 can be located in any one of three positions near the upper end of said post. As will presently be explained, the other end 26 of the actuator is, in effect, pivotally connected at a selected point along the major length 15 of the lifting arm by virtue of the fact that the bracket 28 can be steplessly adjusted in position along it. In FIG. 1 the bracket 24 is shown to have been secured in the lowest of the three possible positions on the pivot post 10, with the brackets 28 secured to the major length 15 of the lifting arm at the outermost end of the latter. In FIG. 2, the bracket 24 is shown to have been secured in the highest of the three possible positions, and the bracket 28 is shown to have been located at the lower end of said major length of the lifting arm. The arrangement is such that, in use of the hoist, as the effective length of the actuator is shortened, the lifting arm 14 is raised, and when its length is increased the lifting arm is lowered.

As shown in FIG. 1, an upper end section 32 of the lifting arm projects at an angle to the major length 15, the arrangement being such that, when the arm is fully raised, said projecting end section extends substantially horizontally (very close to the roof lining when the hoist has been installed in an estate type vehicle or people carrier). The effective length of the projecting end section 32 is made variable by the provision of an extension element 34 located within said end section and steplessly adjustable, as will presently be described, in order to adjust the possible reach of the lifting arm.

Figure 3:
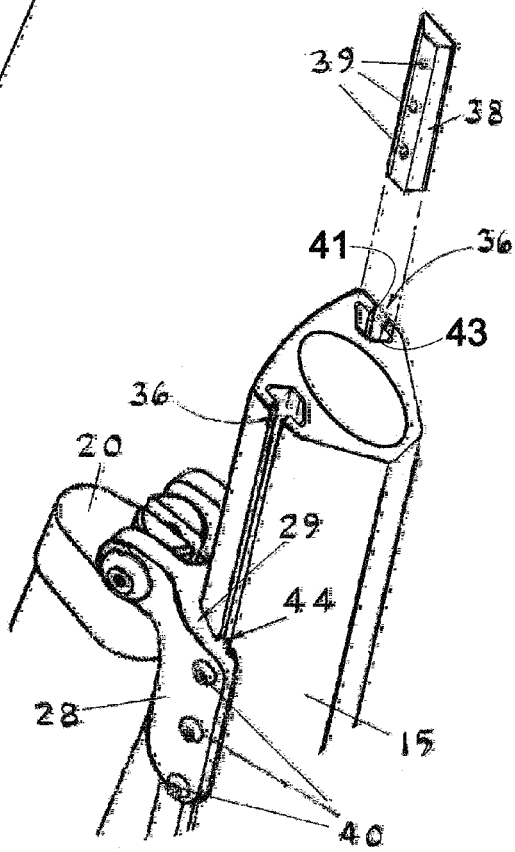

The major length 15 of the lifting arm and the projecting end section 32, within which the extension element 34 is located have the cross sectional shape illustrated in FIGS. 3 and 4, that is to say having a bore 42 of oval shape and an external shape which at one end of the oval fairly closely conforms to the shape of the hollow bore within it but at the other end of the oval widens considerably as shown. It does so sufficiently to enable a pair of longitudinally extending slots 36,36 to open along the opposite side edges of the section, these are undercut slots of the cross-sectional shape shown in FIGS. 3 and 4 and are provided for the purpose of receiving clamping plates 38 such as that shown in exploded view in FIG. 3. The cross-sectional shape of the slots 36 may be described as including a stem 41 and an arm 43. Each clamping plate is formed with three tapped holes 39 which are engaged by respective clamping bolts 40 as the bracket 28 is secured in a required position on the major length 15 of the lifting arm. Clearance holes for the bolts in side walls 29 of the bracket are formed in line with, and of the same width as, longitudinally extending key elements 44 formed on the inside surfaces of said sidewalls. In this way the heavy loads imposed on the lifting arm by the actuator are taken by said key pieces and spread evenly along the length of the side walls of the bracket.

The construction and form of the major length of the lifting arm lends itself ideally towards the making of two further steplessly variable adjustments to the mechanism, these being the means whereby the extent by which the extension element 34 can be caused to project beyond the outer end of the end section 32 of the lifting arm, and the manner in which adjustments of the overall height of the lifting arm can be effected, both of these adjustments being made independently of the other. In FIG. 4 there is illustrated the means whereby the extension element 34, which is of the external size and shape of the bore of the major length of lifting arm section previously referred to, and is a sliding fit within the end section 32 of the lifting arm, can be clamped in an adjusted position. As shown, clamping is effected by means of a clamp, generally indicated 48, secured by bolts 47 in a slot 49 formed on the top side of said end section, near its outer end. The bolts extend through clearance holes 51 in the clamp, then extend through the respective slots 36 (which in this section of lift arm are unused) before engaging tapped holes 53 in the body of the section immediately below said slots. The clamp 48 has been formed from a short section of the extrusion previously referred to. It has therefore a central portion 46 which matches the contour of the top side of the extension element 34 against which it abuts.

The third stepless adjustment which can be made is an adjustment by means of which the overall length of the lifting arm 14 can be varied, this being effected by adjusting the extent by which a lowermost section 13 of the lifting arm extends downwards from the major length 15. Said lowermost section has been made from the same cross section material as the extension element 34 referred to above to be a sliding fit in said major length. The lower end of the length of material used has been formed as shown, by cutting away material on opposite sides of the oval cross section to form two side walls through which the pivotal connection indicated 16 is made. The same type of clamp arrangement illustrated in FIG. 4 is used near the lower end of the major length 15, as indicated at 17 in FIGS. 1 and 2, whereby the stepless adjustments can be made.

Figures 5, 6, 7, 8:
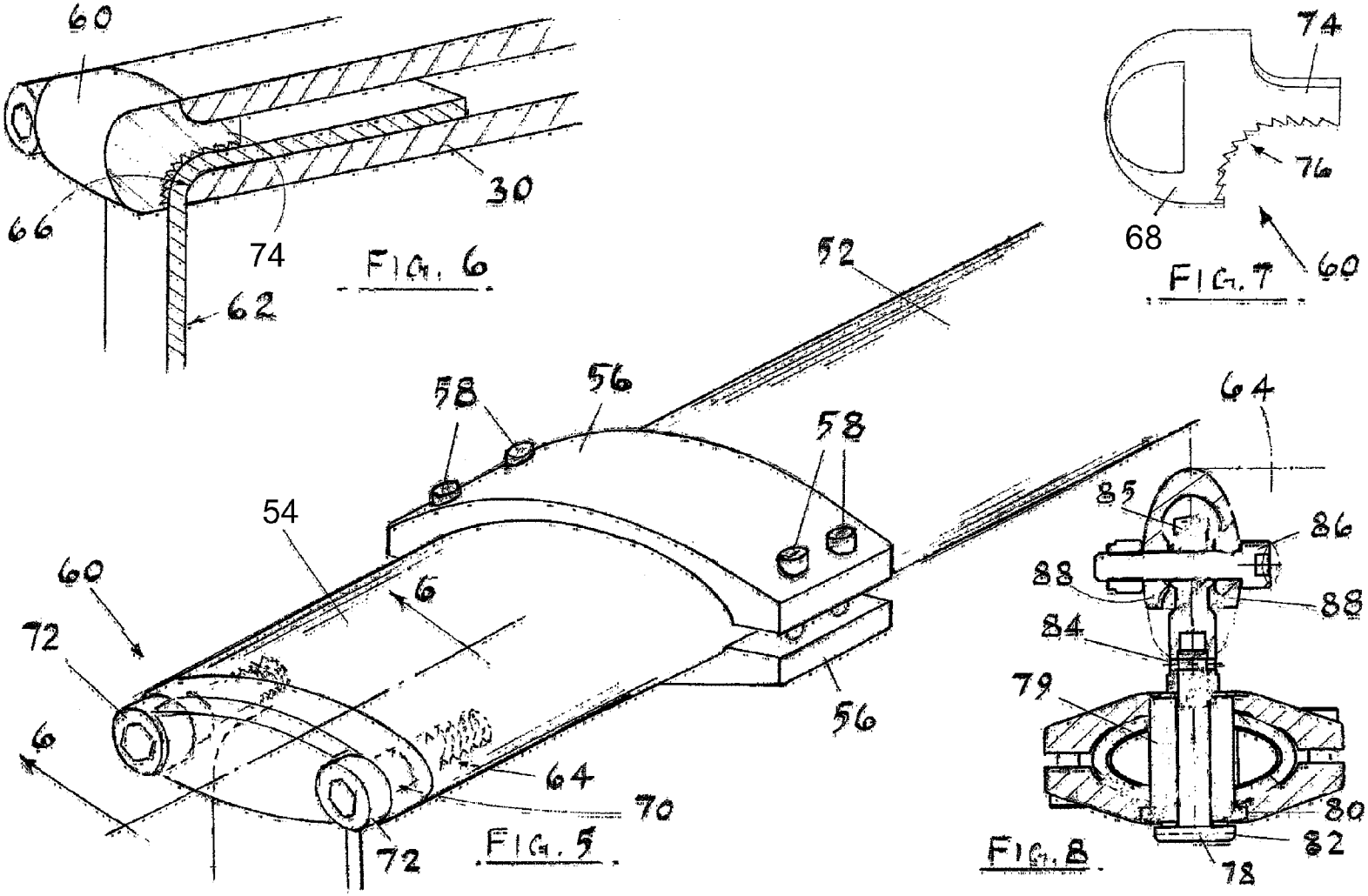
FIG. 5 is a perspective view of a part of a cross beam extender assembly.
FIG. 6 is a sectional view on the line 6-6 in FIG. 5.
FIG. 7 is a side view of a component part shown in section in FIG. 6.
FIG. 8 is a sectional view of a swivel pin mounting arrangement for a lifting bar forming part of the cross beam extender arrangement.

A so-called cross beam extender assembly, generally indicated 50 in FIGS. 1 and 2, is located immediately beneath the end section 32 of the lifting arm 14 and is suspended from an end portion of the extension element 34 in a manner which will be described presently. Referring in particular to FIGS. 5 to 7, the cross beam extender assembly includes a lifting bar 52 which, at its opposite ends, is fitted with width extension elements 54 (see FIG. 5) these being slidably adjustable within its end sections and able to be securely fixed in their adjusted positions by respective pairs of clamps 56, 56 located at the opposite ends of the lifting bar. Clamping bolts 58, 58 connect each pair of clamps together, holes through which said bolts extend being countersunk in one part to receive the bolt heads and tapped in the other part to receive the screw-threaded end of said bolts. When tightened, said bolts cause the clamps to inwardly compress end sections of the lifting bar so that they securely grip the extension elements 54, 54 in positions to which they have been adjusted to suit the width of the load to be lifted.

The outermost ends of the width extension elements 54, 54 are provided with respective clamp elements, generally indicated 60,60 for securely fixing in place flexible lifting straps or webbing 62,62 from which a wheelchair or scooter can be suspended. As shown in FIG. 6, the outer ends of said extension elements, which have been formed from a length of material of oval cross section with a generally rectangular central core, have been prepared by having longitudinally extending screw-threaded holes 64, 64 (see FIG. 5) formed in the relatively thick wall thickness flanking the rectangular core, and also by having the lowermost edge of the cavity, into which an end of a lifting strap is to be fed, rounded as shown at 66 in FIG. 6.

Each clamp element 60 is formed as shown in FIGS. 6 and 7, that is to say with a body part 68 shaped in part to match the oval cross-sectional shape of the extension elements, and with a neatly rounded central portion. Stepped portions at both sides of said central portion have clearance holes 70,70 for bolts 72 which engage the screw-threaded holes 64 in the wall thickness of the respective extension element.

As seen in FIGS. 6 and 7, a projecting tongue portion 74 of each clamp element is provided to extend into the rectangular core of the extension element to which the clamp element has been secured. Said tongue portion is of a slightly lesser width than the rectangular core of the extension element and is of a thickness to fill the remaining depth of the core when a length of flexible lifting strap 62 has been entered into it (see FIG. 6).

As shown most clearly in FIG. 7, the underside of the tongue portion is serrated in a way which maximizes any tendency for the lifting strap to slide out from a set position under load. It will also be seen that the serrations 76 continue in a part-circular arc which, in use, is spaced from the rounded edge of the lowermost part of the extension element at a distance slightly less than the thickness of the strap (which it will be understood will be slightly compressible). It will be understood that when the bolts 72,72 are tightened to secure a clamp element on the end of the extension element, the strap beneath it will be tightly clamped in position. In use and when under load, the resistance to pulling out of the strap from the extension element will be spread along the entire length of strap in contact with the serrations.

Referring now to FIG. 8, this illustrates the manner in which the cross beam extender assembly is suspended beneath the extension element 34 of the lifting arm 14. As shown, a swivel pin 78 extends vertically through a bearing bush 79 which has been fitted into the lifting bar 52 at a point midway along its length. The bearing bush has a shoulder portion 80 which abuts against the underside of said lifting bar and the swivel pin 78 has a shoulder portion 82 which abuts against the underside of the bearing bush.

The upper end of the swivel pin 78 is connected, as shown, by a cross pin 84 to a hanger 85 which is itself pinned in position, by a locating pin 86, between projecting side wall portions 88 of the lifting bar 52 (these having been formed by the removal of a lower portion at the extreme end of the bar as indicated in chain-dotted lines in FIG. 8).

Thus there is provided a hoist construction which, by virtue of the several steplessly variable adjustments provided, can be installed in a vehicle relatively easily. Also, by the use of those adjustments, it is possible to provide the maximum amount of headroom when loading or unloading an article of relatively awkward height in a vehicle of modest size, for example when transporting a powered wheelchair or scooter in an estate type vehicle or people carrier.

The very smallest amount of headroom gained in this way may be important when fitting the mechanism into a vehicle or when re-fitting it in a slightly different vehicle. However, various modifications could be made. For example, the actuator need not necessarily be electric motor operated. If used in a commercial vehicle the actuator could well be a double acting hydraulic cylinder.

The foregoing has described a hoist mechanism. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A hoist mechanism comprising:

a lifting arm comprising a major length with first and second ends, and an upper end section having first and second ends, wherein the first ends of the major length and upper end section join each other in a rigid stationary connection, at a nonparallel angle, such that collectively, the major length and the upper end section define a generally L-shaped structure;

an extension element slidably connected to the second end of the upper end section in a telescoping relationship, so as to make a length of the upper end section variable;

a lowermost section slidably connected to the second end of the major length in a telescoping relationship, so as to make a length of the major length variable; and an actuator having an upper end pivotally connected to a first bracket which is directly connected to the major length of the lifting arm near the first end thereof; wherein:

the major length of the lifting arm comprises longitudinally extending undercut slots having a T-shaped cross-sectional shape with a stem and an arm along side edges of the major length, the stems of the T-shape being exposed at external surfaces of the side edges;

clamping plates with threaded holes are disposed in the arm of the T-shape; and the first bracket is clamped to the lifting arm by clamping bolts extending through clearance holes in side walls of the first bracket and engaging the threaded holes.

2. The hoist mechanism according to claim 1, wherein the side walls of the first bracket comprise key elements on their inside surfaces which engage the longitudinally extending slots in side walls of the major length of the lifting arm.

3. The hoist mechanism according to claim 1, wherein at least the major length of the lifting arm is formed from a length of material having a bore of oval cross section and an external shape which at one end of a major axis of the oval hollow bore closely conforms to the shape of the hollow bore therein but at the other end of the major axis of the oval hollow bore widens so that the widened wall thickness of the external shape comprises the undercut slots.

4. The hoist mechanism according to claim 2, wherein the upper end section of the lifting arm is also formed from a length of the material from which the major length of the lifting arm is formed, and an extent by which the extension element, in use, can be projected beyond an outer end of the upper end section of the lifting arm is adjusted by a slot on a top side of the upper end section near its outer end and fitting of a clamp therein to bear down on the extension element.

5. The hoist mechanism according to claim 4, wherein the clamp is formed from a short length of the upper end section material and comprises bolts, in use, extending through clearance holes of the clamp, whereby the bolts are received by screw-threaded holes which open from an underside of the undercut slots in the widened wall thickness of the upper end section.

6. The hoist mechanism according to claim 5, comprising a cross beam extender assembly having a lifting bar which, at its opposite ends, is fitted with respective extension elements which are, in use, slidably adjustable to extend from end sections of the lifting bar wherein:

outermost ends of the extension elements are provided with respective clamp elements for securely fixing in place a flexible lifting strap from which, in use, a wheelchair or scooter is suspended;

the outermost ends comprise longitudinally extending screw-threaded holes formed in a sidewall thickness of a hollow section from which the extension element has been formed;

a lowermost edge of a cavity opening into the hollow section of the extension element, into which an end portion of the lifting strap is fed in use, is rounded;

each clamp element has a body part reciprocally shaped in part to match outer cross sectional shape of the extension element;

the clamp element comprises a clearance hole for a bolt and a projecting tongue portion;

the bolt, in use, engages the screw-threaded hole in the sidewall thickness of the extension element;

the projecting tongue portion, in use, extends into a space remaining above the lifting strap when the end portion thereof is fed into the hollow section of the extension element; and the tongue portion comprises a serrated underside, serrations thereof extending transversely from a length of the tongue portion.

7. The hoist mechanism according to claim 6, wherein the serrations on the serrated underside of the tongue portion continue in a part-circular arc so that, in use, as clamping is effected, they are spaced from a rounded edge of a lowermost part of the extension element at a distance less than a thickness of the compressed lifting strap.

8. The hoist mechanism according to claim 7, wherein the clamp elements comprise stepped portions in which heads of the bolt will be at least partly located, and rounded portions which, in use, form outermost ends of the cross beam extender assembly.

9. The hoist mechanism according to claim 1, wherein the actuator is positioned such that reducing the length of the actuator raises the lifting arm.

10. The hoist mechanism according to claim 1, further comprising:

a pivot post configured to be mounted to a supporting structure;

wherein the lowermost section is pivotally connected to a second bracket which is connected to the pivot post; and wherein the actuator has a lower end pivotally connected to a third bracket which is connected to the pivot post at a location spaced-away from the second bracket, such that the pivot post, the major length, and the actuator each form a leg of a triangular configuration.

* * * * *